US010276965B2

(12) United States Patent
Herbrechtsmeier et al.

(10) Patent No.: US 10,276,965 B2
(45) **Date of Patent: *Apr. 30, 2019**

(54) HOLDING FRAME FOR PLUG-IN CONNECTOR MODULES WITH A LOCKING ELEMENT UNDER PRESTRESS

(71) Applicant: HARTING Electric GmbH & Co. KG, Espelkamp (DE)

(72) Inventors: Heiko Herbrechtsmeier, Bünde (DE); Heiko Meier, Minden (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/754,567

(22) PCT Filed: Aug. 17, 2016

(86) PCT No.: PCT/DE2016/100368

§ 371 (c)(1),
(2) Date: Feb. 22, 2018

(87) PCT Pub. No.: WO2017/036447

PCT Pub. Date: Mar. 9, 2017

(65) Prior Publication Data

US 2018/0248296 A1 Aug. 30, 2018

(30) Foreign Application Priority Data

Sep. 3, 2015 (DE) ..... 10 2015 114 696

(51) Int. Cl.
*H01R 13/514* (2006.01)
*H01R 13/506* (2006.01)
(Continued)

(52) U.S. Cl.
CPC ..... *H01R 13/506* (2013.01); *H01R 13/508* (2013.01); *H01R 13/514* (2013.01); *H01R 13/518* (2013.01)

(58) Field of Classification Search
CPC ..... H01R 13/514
(Continued)

(56) References Cited

U.S. PATENT DOCUMENTS 3,160,280 A 12/1964 Burch
4,693,440 A 9/1987 Lalonde
(Continued)

FOREIGN PATENT DOCUMENTS

CN 201656162 U 11/2010
CN 202084755 U 12/2011
(Continued)

OTHER PUBLICATIONS

German Office Action, dated Aug. 10, 2016, for German Application No. 10 2015 114 696.7, 8 pages (no English translation provided).
(Continued)

*Primary Examiner* — Phuong K Dinh
(74) *Attorney, Agent, or Firm* — Seed IP Law Group LLP

(57) ABSTRACT

The disclosure relates to a holding frame into which plug-in connector modules are insertable, wherein the holding frame comprises or consists of two interconnectable halves, a first half and a second half, wherein the holding frame has at least one locking element, and wherein the halves are alignable and fixable in at least two positions with respect to each other via the locking element. The locking element is fastened under prestress to the halves and the prestress causes the exertion of a force which fixes the holding frame either in an open position or in a closed position.

8 Claims, 5 Drawing Sheets

(51) Int. Cl.
*H01R 13/508* (2006.01)
*H01R 13/518* (2006.01)

(58) Field of Classification Search
USPC ..... 439/701, 540.1
See application file for complete search history.

(56) References Cited

U.S. PATENT DOCUMENTS

| | | | | |
|---|---|---|---|---|
| 5,529,426 | A | 6/1996 | Masuda et al. | |
| 5,829,910 | A | 11/1998 | Kameyama | |
| 6,004,162 | A | 12/1999 | Harting et al. | |
| 6,196,869 | B1 | 3/2001 | Kay et al. | |
| 6,350,141 | B1 | 2/2002 | Houtz | |
| 6,692,310 | B2 | 2/2004 | Zaderej et al. | |
| 7,066,677 | B2 | 6/2006 | Rüter | |
| 7,753,701 | B2 | 7/2010 | Tsuji | |
| 7,896,694 | B2 | 3/2011 | Schumann et al. | |
| 8,292,676 | B2 | 10/2012 | Schmidt et al. | |
| 8,449,314 | B1 | 5/2013 | Feist et al. | |
| 8,668,530 | B2 | 3/2014 | Riepe et al. | |
| 8,821,186 | B2 | 9/2014 | Lan | |
| 8,979,568 | B2 | 3/2015 | Herbrechtsmeier et al. | |
| 9,502,813 | B2 | 11/2016 | Dugo | |
| 9,577,365 | B1 * | 2/2017 | Herbrechtsmeier | H01R 13/518 |
| 9,608,374 | B2 | 3/2017 | Beischer et al. | |
| 9,847,608 | B2 | 12/2017 | Bruex et al. | |
| 9,923,307 | B2 | 3/2018 | Beischer et al. | |
| 2005/0070146 | A1 | 3/2005 | Lu | |
| 2006/0035501 | A1 | 2/2006 | Lewis et al. | |
| 2007/0155252 | A1 | 7/2007 | Ferderer | |
| 2010/0159728 | A1 | 6/2010 | Wang et al. | |
| 2014/0179171 | A1 * | 6/2014 | Mortun | H01R 25/142 439/701 |
| 2018/0026405 | A1 | 1/2018 | Schlepp et al. | |
| 2018/0241149 | A1 | 8/2018 | Herbrechtsmeier et al. | |
| 2018/0248297 | A1 | 8/2018 | Herbrechtsmeier et al. | |
| 2018/0248298 | A1 | 8/2018 | Schönfeld et al. | |
| 2018/0254576 | A1 | 9/2018 | Herbrechtsmeier et al. | |
| 2018/0254577 | A1 | 9/2018 | Herbrechtsmeier et al. | |
| 2018/0254578 | A1 | 9/2018 | Herbrechtsmeier et al. | |
| 2018/0269621 | A1 | 9/2018 | Schönfeld | |
| 2018/0277978 | A1 | 9/2018 | Schönfeld et al. | |

FOREIGN PATENT DOCUMENTS

| | | | |
|---|---|---|---|
| CN | 202352910 | U | 7/2012 |
| CN | 104466562 | A | 3/2015 |
| CN | 204205152 | U | 3/2015 |
| CN | 204271392 | U | 4/2015 |
| DE | 197 07 120 | C1 | 6/1998 |
| DE | 197 45 384 | A1 | 4/1999 |
| DE | 20 2005 020 026 | U1 | 4/2006 |
| DE | 20 2012 103 360 | U1 | 3/2013 |
| DE | 20 2013 103 611 | U1 | 11/2013 |
| DE | 10 2013 106 279 | A1 | 12/2014 |
| DE | 10 2015 101 433 | B3 | 6/2016 |
| EP | 0 843 384 | A2 | 5/1998 |
| EP | 2 581 991 | A2 | 4/2013 |
| FR | 2 860 348 | A1 | 4/2005 |
| GB | 1 394 867 | A | 5/1975 |
| WO | 2014/155171 | A1 | 10/2014 |

OTHER PUBLICATIONS

International Search Report and Written Opinion, dated Nov. 18, 2016, for International Application No. PCT/DE2016/100368, 9 pages (with English translation of the Search Report).

Harting Elektronik GmbH, "Schwere Steckverbinder Han-Modular®," Product Catalog, Jan. 1999, 44 pages.

International Preliminary Report on Patentability, dated Mar. 6, 2018, for International Application PCT/DE2016/100368, 13 pages. (with English Translation).

Written Opinion of the International Search Authority, dated Nov. 18, 2016, for International Application No. PCT/DE2016/100368, 6 pages. (English Translation).

* cited by examiner

HOLDING FRAME FOR PLUG-IN CONNECTOR MODULES WITH A LOCKING ELEMENT UNDER PRESTRESS

BACKGROUND

Technical Field

This disclosure relates to a holding frame for plug-in connector modules.

Such holding frames serve for holding plug-in connector modules, wherein the holding frame is fitted with various plug-in connector modules and is then inserted into a plug-in connector housing and screw-fastened to the latter. Here the holding frame must be mechanically stable, in order to be able to withstand the insertion and withdrawal forces that occur when joining and separating the plug-in connection.

DESCRIPTION OF THE RELATED ART

DE 197 07 120 C1 discloses a holding frame for plug-in connector modules. The holding frame comprises two halves which are connected to one another via a joint. Catches of the plug-in connector modules engage in recesses in the side faces of each half.

The joint or the end-face joints are arranged in the fixing ends of the holding frame. When screwing the holding frame onto a fixing face, the frame parts align in such a way that the side parts of the holding frame are oriented at right-angles to the fixing face. The plug-in connector modules are thereby fixed in the holding frame.

The holding frame in DE 197 07 120 C1 does not have a clearly defined open position for fitting plug-in connector modules to the holding frame. This sometimes results in a rather awkward assembly, particularly by unpracticed personnel.

When the holding frame has been successfully fitted with plug-in connector modules it must be brought into a closed state or rather a closed position in order to fix the plug-in connector modules securely. In the closed state of the holding frame of prior art there is no fixed, closed state, so that the holding frame can accidently open, allowing the modules to fall out of their anchorage.

A purely articulated connection does not always afford a definite electrical contact between the halves of the holding frame. It is thereby not possible to guarantee reliable use of the holding frame for grounding purposes.

DE 20 2012 103 360 U1 shows a holding frame for plug-in connector modules, which comprises two frame halves, which can be latched together by linearly sliding the one frame half relative to the other frame half.

CN 204 205 152 U shows a holding frame for plug-in connector modules. The holding frame comprises two halves which are connected to one another via a joint and by spiral springs at each of the ends. Throughout the entire process of fitting components to the holding frame the fitter is obliged to work against the spring force of the spiral spring.

CN 201 656 162 U shows a holding frame for plug-in connector modules. The holding frame comprises two halves which are connected to one another by spiral springs at each of the ends. The halves are drawn longitudinally together by the spiral springs. When fitting plug-in connector modules to the holding frame, care must be taken to ensure that the ends of the holding frames are equally separated from one another, in order to allow easy insertion of the plug-in connector modules. When returning the halves care must further be taken to ensure that the ends are returned equally parallel, since otherwise the modules snag in the side parts of the halves.

All in all, the process of fitting connectors in CN 204 205 152 U is very awkward and often leads to jamming or snagging of the plug-in connector modules.

BRIEF SUMMARY

Embodiments of the present invention provide a holding frame which is easy to handle and versatile in its use.

The holding frame according to an embodiment of the present invention is intended to receive plug-in connector modules and then to be fitted into a plug-in connector housing. The holding frame comprises two halves that can be connected together, a first half and a second half. The holding frame comprises at least a first locking element.

The halves can be oriented in at least two positions relative to one another and can be fixed to one another in at least two positions via the first locking element. The facility for orienting the halves is achieved by the articulated connection, which is described in more detail below.

The holding frame advantageously has a center of rotation at each end, wherein the connecting line between the centers of rotation forms an axis of rotation, which runs parallel to the side faces of the halves. The halves of the holding frame can be turned and oriented relative to one another along the axis of rotation. As a rule the centers of rotation are formed by a joint head, which is guided in a matching joint socket and is described in more detail below.

The first locking element preferably has an arched shape. It could also be described as a U-shape. One end of the locking element is held on the first half and the other end of the locking element is held on the second half.

It is particularly advantageous if the first locking element is fixed to the halves under prestress and if the prestressing exerts a force which fixes the holding frame in an open position or in a closed position. The force exerted by the prestressing is used to fix the holding frame in a closed or an open position. In orienting the halves, the user has first to overcome a counterforce, until the holding frame remains in the respective position (open or closed) and is fixed in this position.

The force resulting from the prestressing of the first locking element acts on the end joints or on the end points of the axis of rotation of the holding frame. Depending on the current orientation of the holding frame, a resulting force acts on the articulated connection and forces the holding frame into a closed or open position.

The prestressing can serve to fix the holding frame both in an open position and in a closed position. With the locking element, fixing in both positions is equally possible.

The holding frame preferably comprises at least a second locking element. The first locking element is preferably arranged on one end face of the holding frame and the second locking element on the opposite end face of the holding frame.

The first locking element is situated on the inside of the first end face of the holding frame. The second locking element is situated on the inside of the second end face of the holding frame. This makes the holding frame, with all its possible scope for orientation, mechanically stable.

The second locking element is preferably of meander-shaped formation. This meander shape assists the orienting movement of the halves.

It is particularly advantageous if the second locking element is also fixed to the halves under a prestress. This prestressing may serve to assist the fixing by the first locking element.

The halves are advantageously composed of a metallic material. In a closed state the halves are in electrically conductive contact with one another. The electrically conductive connection between the halves may also be produced or assisted by the locking element. For this purpose the locking element(s) may likewise be composed of an electrically conductive material.

The term "open position" means that the halves are situated at an angle α other than 180° to one another along the parting line. The angle is preferably between 130° and 170°. An angle of between 155° and 165° has proved particularly advantageous. With the halves in this angular position it is particularly easy to insert the plug-in connector modules into the holding frame. In the closed position the halves assume an angle of approximately 180° or precisely 180° to one another. The halves are therefore situated parallel to one another in the closed position.

The locking element serves to bring the two halves reliably into electrical contact with one another. This is done firstly via the locking element itself, provided that it is made of an electrically conductive material. In addition the prestressing of the locking element serves to press the joint head of one half into the joint socket of the other half, thereby producing a reliable electrical contact.

BRIEF DESCRIPTION OF THE SEVERAL VIEWS OF THE DRAWINGS

Exemplary embodiments of the invention are represented in the drawings and are explained in more detail below. In the drawings.

The figures contain in some cases simplified, schematic representations. Identical reference numerals are sometimes used for similar but possibly not identical elements. Different views of the same elements might be drawn to different scales.

DETAILED DESCRIPTION

Figure 1:
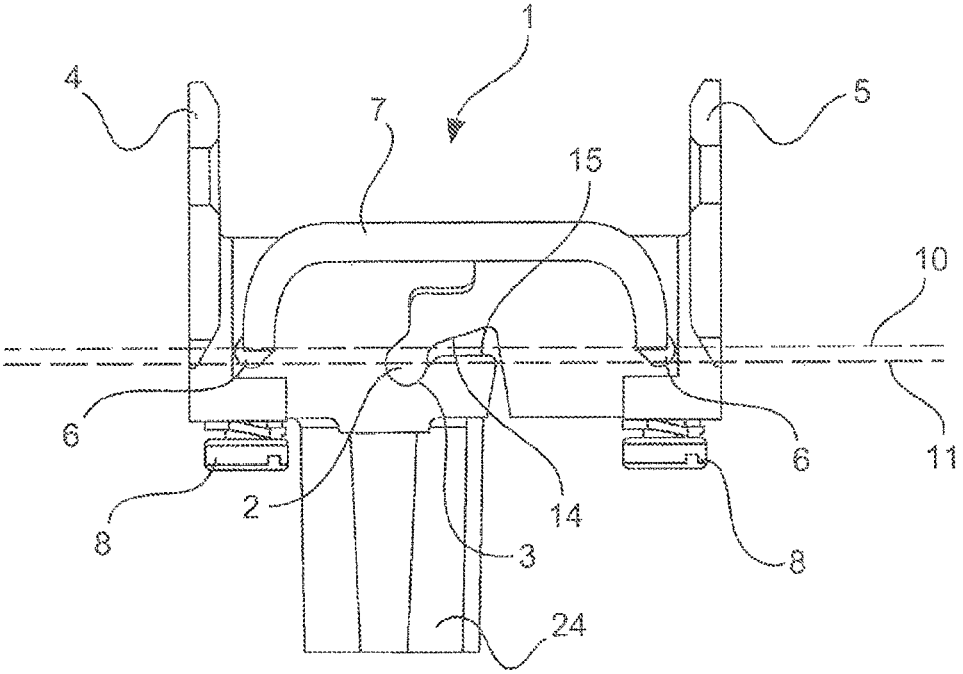
FIG. 1 shows a side view of a holding frame having with a first locking element in a closed position.

FIG. 1 shows a holding frame 1 in a closed position. The holding frame 1 substantially comprises two halves 4, 5, which are connected to one another via a joint 2, 3. For this purpose one half 5 comprises a joint head 2 at each of the end faces, which engages in a joint socket 3 of the opposing half 4 provided for this. This is termed an articulated connection of the two halves 4, 5 of the holding frame.

Figure 7:
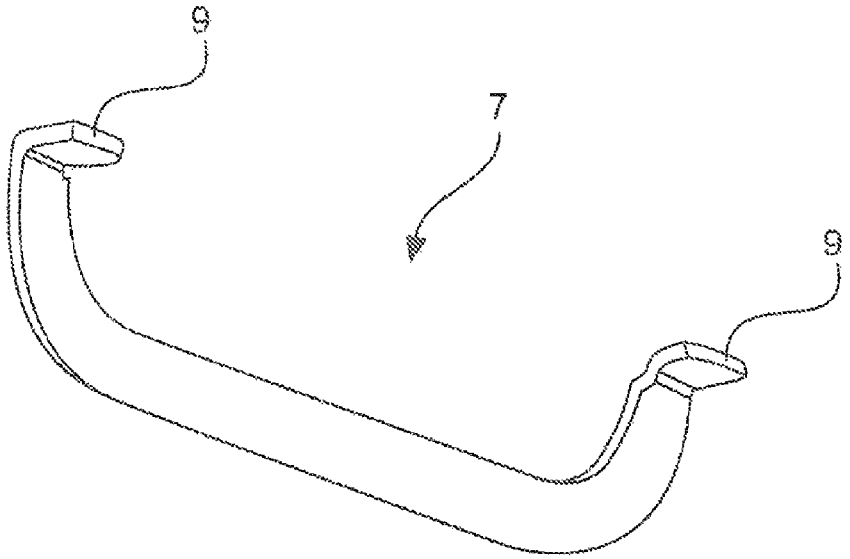
FIG. 7 shows a perspective representation of a first locking element.
Figure 8:
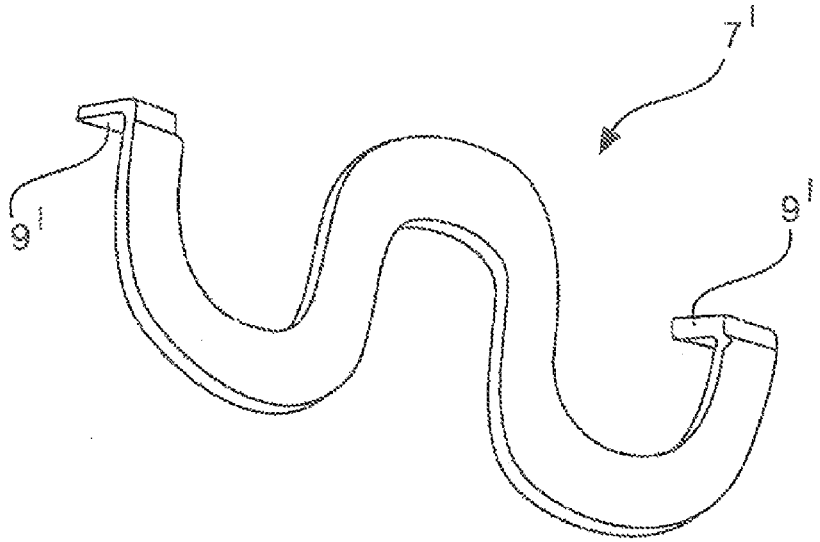
FIG. 8 shows a perspective representation of a second locking element.

The holding frame 1 comprises a first locking element 7, which is of substantially U-shaped formation. The first locking element 7 is represented in FIG. 7. The ends of the first locking element 7 are bent over by 90°. The bent-over areas thus form so-called catches 9.

The halves 4, 5 of the holding frame 1 each have a recess 6. The catches 9 of the first locking element 7 engage in the recesses 6, so that the first locking element 7 is fixed to the inside of an end face of the holding frame 1.

The first locking element 7 is inserted into the recesses 6 under prestress. Due to the prestressing the ends of the first locking element 7 exert a force towards one another along a virtual stress line 10. A center line 11 of the joint head 2 and of the articulated connection of the halves 4, 5 of the holding frame 1 is drawn in in FIGS. 1 and 2.

The working principle of the first locking element 7 is explained in more detail below. Due to the prestressing of the first locking element 7, a force is exerted on the articulated connection of the holding frame 1. A resulting force causes the halves 4, 5 to adopt a closed and/or open position relative to one another. This means that opening the holding frame 1 beyond a specific point causes it to remain in the open position. When the halves 4, 5 are then brought together they stay in the closed position.

Figure 2:
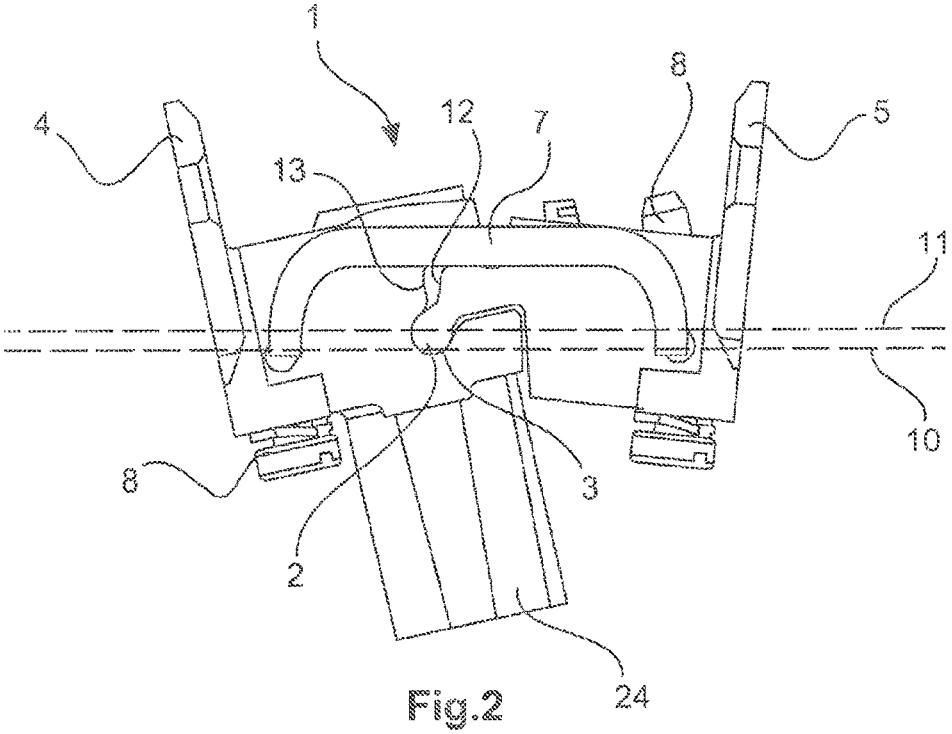
FIG. 2 shows a side view of a holding frame with a first locking element in an open position.
Figure 3:
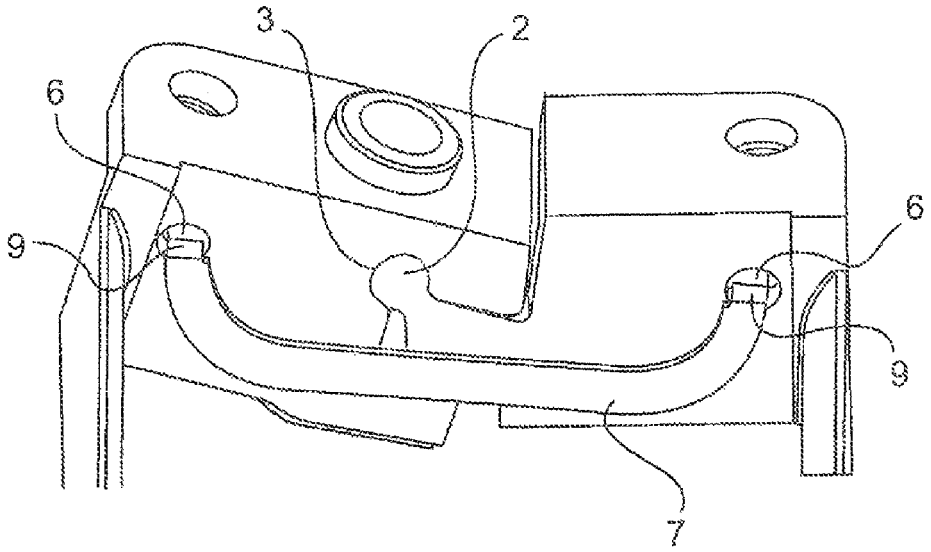
FIG. 3 shows a perspective representation of a detail of the holding frame with a first locking element in an open position.

The resulting force of the locking element 7, 7', 107 gives rise to a stress line 10 in the area of the joint 2, 3 or the articulated connection. If the stress line 10 is situated above the center line of the joint 2, 3, the halves 4, 5 are brought into a closed position of the holding frame 1 relative to one another (FIG. 1). Here a first stop 12 branching off from the joint head 2 is pressed against a first stop 13 of the first half 4. If the stress line 10 is situated below the center line 11, a second stop 14 branching off from the joint head 2 is pressed against a second stop 15 of the first half 4. The halves 4, 5 and the holding frame 1 are thereby fixed in an open position (FIG. 2).

Figure 4:
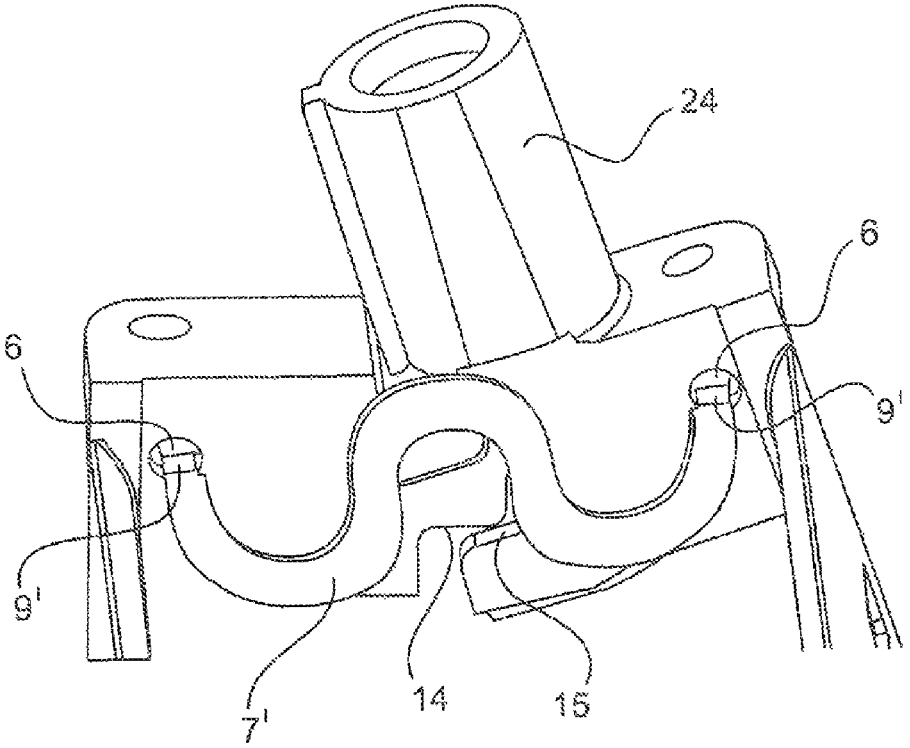
FIG. 4 shows a perspective representation of a further detail of the holding frame with a second locking element in an open position.
Figure 5:
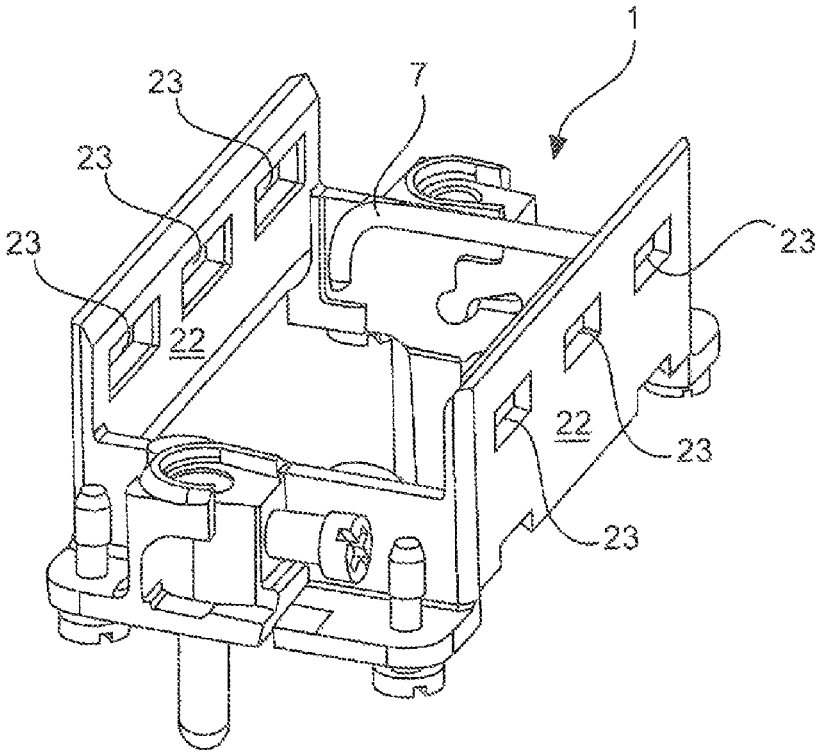
FIG. 5 shows a perspective representation of the closed holding frame with a first locking element.

According to the embodiment shown in FIG. 4, a second locking element 7' is fixed on an opposite, inner end face of the holding frame 1. This locking element is of substantially meander-shaped design and at each end comprises catches 9', which are held in recesses 6 on the halves 4, 5. A loop of the meander-shaped, second locking element 7' is situated on a level with the joint 2, 3. The meander-shaped second locking element 7' substantially supports the articulated connection of the halves 4, 5 and furnishes a return force from the open to the closed position. This makes the holding frame easier to operate.

Figure 6:
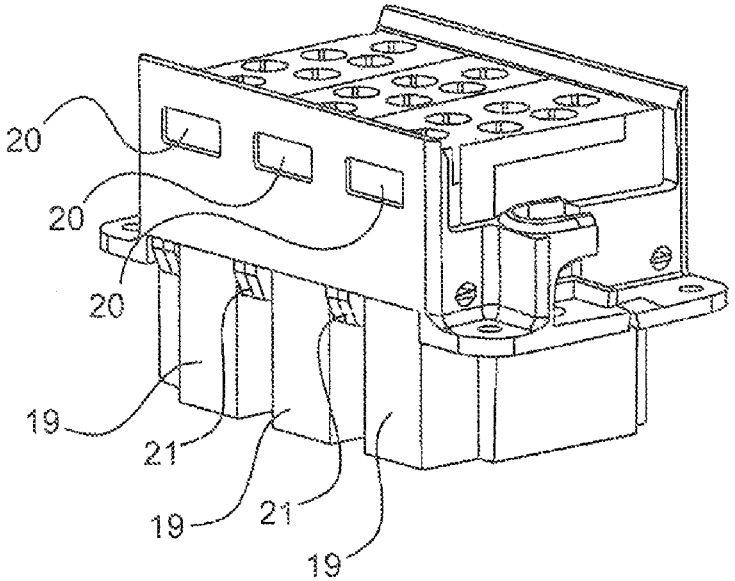
FIG. 6 shows a perspective representation of the closed holding frame with integrated plug-in connector modules.

Plug-in connector modules 19 (FIG. 6) have long been known and are described, for example, in DE 197 07 120 C1. The plug-in connector modules 19 are provided with projecting, approximately rectangular mounts 20 and sprung catches 21. Fully enclosed openings 23, into which the mounts 20 sink when inserting the plug-in connector modules 19 into the holding frame 1, are provided in the side parts 22 of the halves 4, 5.

The holding frame 1 comprises a grounding socket 24, in which a pin (not shown) of an opposing holding frame (not shown) can engage.

Figure 9:
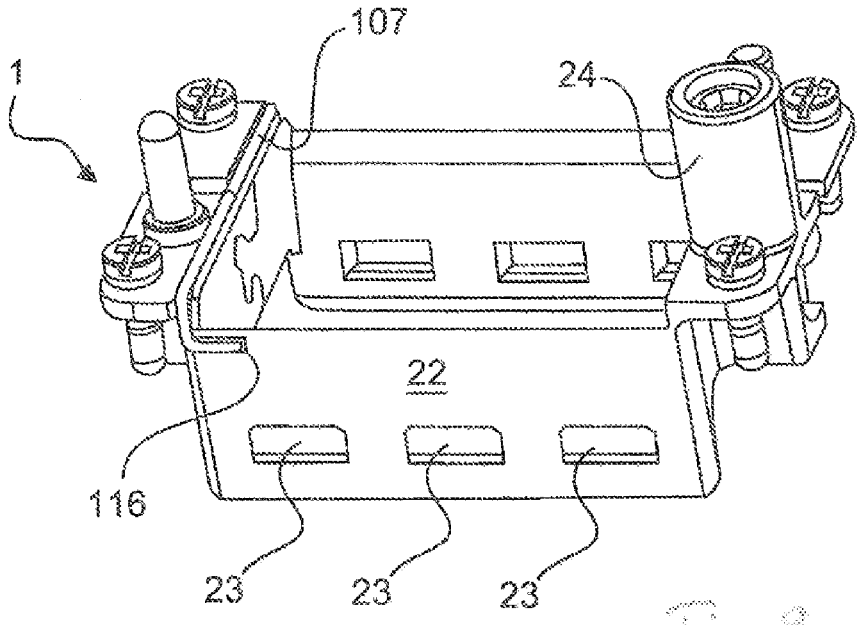
FIG. 9 shows a perspective representation of a holding frame with an alternative locking element
Figure 10:
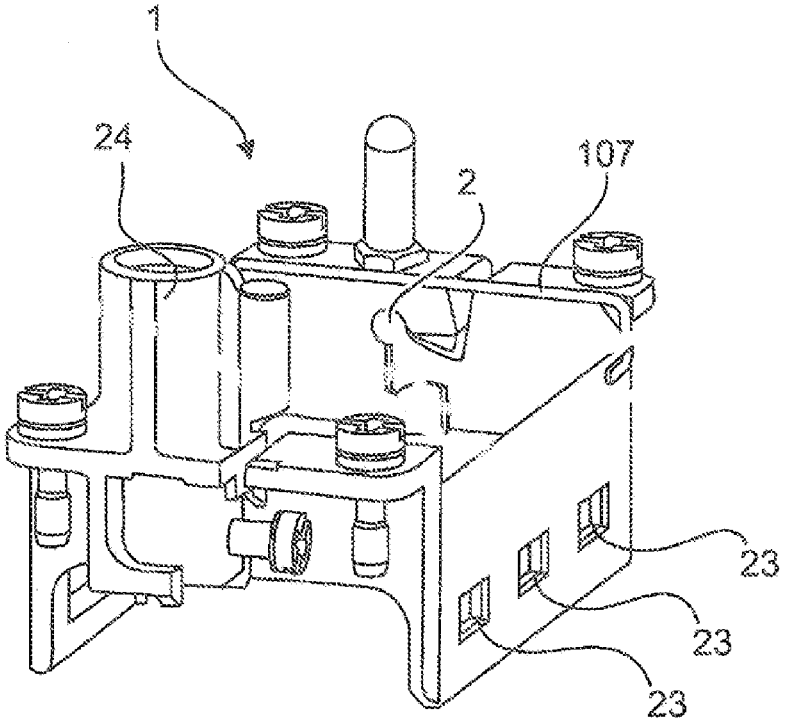
FIG. 10 shows a further perspective representation of the holding frame with an alternative locking element.

FIGS. 9 and 10 show a holding frame 1 with an alternative locking element 107. The locking element 107 comprises a sprung wire piece, which conforms to the frame shape of the holding frame 1. For that reason this embodiment is particularly preferable. The locking element 107 in FIGS. 9 and 10 has a different geometric shape from the locking elements 7, 7' in FIGS. 1-5. The working principle is substantially the same, however. One difference, however, is that the alternative locking element is arranged below the joint 2, 3 and thereby draws the frame halves directly together. The term "below the joint 2, 3" here means that the alternative locking element 107 is arranged counter to the insertion direction of the plug-in connector modules 19.

Embodiments of the invention relate to a holding frame 1, in which plug-in connector modules 19 can be inserted, wherein the holding frame 1 comprises two halves 4, 5 that can be connected to one another, a first half 4 and a second half 5, wherein the holding frame 1 comprises at least a first locking element 7 and wherein the halves 4, 5 can be oriented in at least two positions relative to one another and fixed to one another via the first locking element 7. The first locking element 7 is fixed to the halves 4, 5 under prestress and due to the prestressing a force is exerted which fixes the holding frame 1 either in an open position or in a closed position.

It has proved particularly effective if a holding frame 1 is provided with a U-shaped locking element 7 on both sides, as is shown in FIG. 7.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A holding frame, into which plug-in connector modules can be inserted, wherein the holding frame comprises two halves articulated with one another, a first half and a second half, wherein the holding frame comprises at least one locking element, wherein the halves can be oriented in at least two positions relative to one another, wherein the locking element is fixed to the halves under prestress and the force resulting from the prestressing serves to fix the holding frame both in an open position and in a closed position, wherein the holding frame comprises a pivot point at each end, and wherein a connecting line between the pivot points forms a rotational axis which extends parallel to side faces of the halves.

2. The holding frame as claimed in claim 1, wherein the holding frame has just one locking element.

3. The holding frame as claimed in claim 1, wherein the locking element is arranged below an articulated connection of the two halves.

4. The holding frame as claimed in claim 1, wherein one end of the locking element is held on the first half and the other end of the locking element on the second half.

5. The holding frame as claimed in claim 1, wherein the locking element has a U-shape.

6. The holding frame as claimed in claim 1, wherein the locking element is meander-shaped.

7. The holding frame as claimed in claim 1, wherein a first locking element is arranged on an end face of the holding frame and a second locking element is arranged on the opposite end face of the holding frame.

8. The holding frame as claimed in claim 1, wherein the halves are composed of a metallic material and in a closed state are in electrically conductive contact with one another.

* * * * *